United States Patent [19]

Lemmer et al.

[11] Patent Number: 4,688,011

[45] Date of Patent: Aug. 18, 1987

[54] MOTOR SAFETY SWITCH

[75] Inventors: Helmut Lemmer, Marienheide-Kalsbach; Josef Risthaus, Dorsten, both of Fed. Rep. of Germany

[73] Assignee: Square D Starkstrom GmbH, Marienheide-Kalsbach, Fed. Rep. of Germany

[21] Appl. No.: 809,195

[22] Filed: Dec. 16, 1985

[30] Foreign Application Priority Data

Dec. 18, 1984 [EP] European Pat. Off. ..... 84115679

[51] Int. Cl.[4] ..... H01H 9/00

[52] U.S. Cl. ..... 335/159; 335/6; 335/120; 335/132; 335/198; 337/6

[58] Field of Search ..... 337/6; 335/6, 103.7, 335/120, 131–132, 133, 159–162, 198, 8–10, 13, 202

[56] References Cited

U.S. PATENT DOCUMENTS

| | | | |
|---|---|---|---|
| 3,638,157 | 1/1972 | Kruzic | 337/6 |
| 4,090,156 | 4/1978 | Gryctko | 335/6 |
| 4,181,906 | 1/1980 | Matsko et al. | 335/132 |
| 4,184,134 | 1/1980 | Kane et al. | 335/132 X |
| 4,300,110 | 11/1981 | Bayer et al. | 335/6 |
| 4,307,358 | 12/1981 | Haury et al. | 335/6 |
| 4,345,225 | 8/1982 | Lemmer | 335/132 |
| 4,470,028 | 9/1984 | Vayre et al. | 335/6 |

*Primary Examiner*—Arthur T. Grimley
*Assistant Examiner*—Jane K. Lau
*Attorney, Agent, or Firm*—Diller, Ramik & Wight

[57] ABSTRACT

A motor safety switch which eliminates much of the costs of conventional wiring, material and labor, the motor safety switch being formed of a plurality of assembled independent components; a first of the components including a switch unit having a contact system, a thermal tripper and a magnetic tripper; a second of the components being an electromagnetic drive unit; a third of the components being a modular contact unit; and the independent components are maintained by mechanical connectors in selected assembled relationship to include either all of the aforementioned independent components or selective subassemblies thereof.

15 Claims, 13 Drawing Figures

MOTOR SAFETY SWITCH

BACKGROUND OF THE INVENTION

This invention relates to motor safety switches of which various designs are known. Typically, such motor protection consists of a relay or contactor associated with a thermal protection mechanism. Accordingly, both the entire contact making system and the magnetic system which actuates the contact system, and the associated thermal protection system, are mounted within a single housing of a specific design. The thermal protection system or mechanism is tripped only when the current load or the thermal load exceeds a given value. In practice, this thermal protection mechanism for the motor operates relatively inertly, because the current load or the thermal load increases quite slowly most of the time. In order to protect a particular electric motor against abrupt electrical interruptions, such as shorts, a separate cut-off is required which heretofore has been mounted in a separate housing outside of the conventional contact housing. Generally a total of eighteeen connections are required for the electrical hook-ups between these separate units. An ordinary circuit breaker is also known which includes a contacting system and a magnetic system connected by means of electric conductors to a separate motor protection switch. This construction requires a total of twelve connections each hooked up to a particular electrical line.

In both of the aforementioned designs the wiring is complex, time consuming, and the material expenditure required both for the electric wiring and the many hook-ups to the different equipment is inordinately high. Furthermore, because of the necessity of extraneous exterior wiring, the space required is increased, thus necessitating a relatively large switch gear cabinet and its attendant higher costs.

Other conventional motor safety or protection systems are known, but these generally vary across a large spectrum of particular components depending upon the intended specific application.

A final typical motor protection system is of the known contactor type in which typical cut off means and the associated accessory contact system are integrated into a single assembly. cSUMMARY OF THE INVENTION The present invention is based upon the recognition that there is a different demand in practice with respect to motor protecting switches or motor safety switches, depending upon particular circumstances. Illustratively, in a few cases only one switch mechanism with a single contact system is required which can be simply turned on and off manually. In such a case, however, the motor protection must be guaranteed for all types of electrical loads. In another system, at a minimum the contact system must be turned on by means of an electromagnet. As another example, motor protecting switches are needed under electrical requirements of one contacting system, one electromagnetic drive and one accessory contact system with the motor protection being assured for every operational eventuality. Obviously, due to these different requirements there are then numerous different designs, and according to the present invention numerous independent components establishing a particular motor safety switch is provided in the absence of eccessive expenditures of money or wiring, material and/or labor. The overall motor safety switch is compact when assembled, can be readily adapted to practically all requirements, can be assembled componentwise as need be without the necessity of maintaining large stocks of items in hand, and the various components, subassemblies and total assemblies thereof are readily interengageable and mutually exchangeable.

In accordance with the present invention a motor safety switch is provided through a series of independent components, namely, a switch unit consisting of a contact system, a thermal tripper and a magnetic tripper; an electromagnetic drive unit and a modular contact unit, all readily maintained in assembled modular relationship. In this manner, one obtains the essential advantage that the individual components are virtually always identical, can be mass produced regardless of what the final configuration of the motor safety switch might be, and in this way the main cost for a particular job requirement is drastically reduced. It should be clear that the individually different motor safety switches for different purposes will make use of only a few different and less costly parts, such as base plates and/or covers, pushbuttons, possibly junction numbers, while the main components are essentially universal for virtually any application. Thus, the different small parts do not represent high manufacturing costs and can be readily assembled to the main major components without undue loss of time, particularly through advantageously provided mechanical connectors and quick couplings of the present invention. Obviously, since the independent components can be assembled into different varieties of motor safety switches, there if no need for stocking large quantities of differently constructed motor safety switches, and instead smaller quantities of basic main components can be stocked and selectively utilized as need be to satisfy a particular requirement by simply constructing a desired motor safety switch therefrom.

In order to reduce the overall size of the motor safety switches which can be constructed from assembled independent components pursuant to this invention, the independent individual components are preferably stacked upon each other perpendicularly to a mounting plane or surface of an associated switch cabinet or the like. When appropriately connected by mechanical connecting means and so assembled, there is generally sufficient space for any stacked number of independent components, simply because most switch cabinets have space available perpendicular to the mounting plane, whereas there is very little space available in the other two coordinates parallel to the mounting plane. The latter occurs because normally conventional devices are mounted in series tightly next to one another and above each other, all of which resulted in the previously noted disadvantages of conventional motor protection switches. However, the latter disadvantage is totally overcome by the perpendicular stacking of the components of the present invention. Furthermore, in keeping with the invention, the individual components or subassemblies are preferably of the same width and as standardized as possible.

With the above and other objects in view that will hereinafter appear, the nature of the invention will be more clearly understood by reference to the following detailed description, the appended claims and the several views illustrated in the accompanying drawings:

DESCRIPTION OF THE PREFERRED EMBODIMENTS

Figure 8:
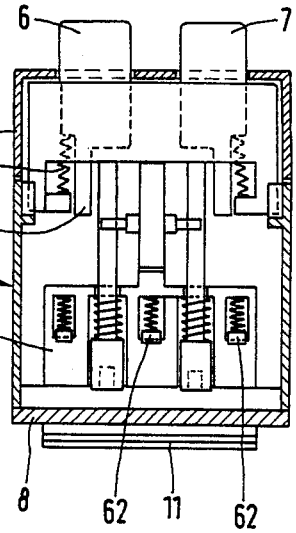
FIG. 8 is a transverse cross-sectional view through the motor safety switch of FIGS. 1 and 7, and illustrates in relatively simplified form some of the conventional components thereof.
Figure 9:
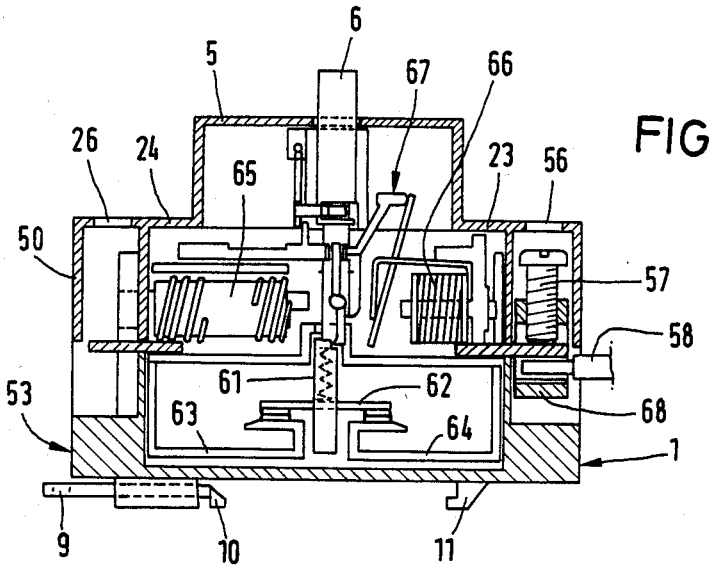
FIG. 9 is a longitudinal sectional view of the motor safety switch of FIGS. 1 and 7, and illustrates further details thereof, including a thermal tripper, a magnetic tripper, and associated contacts.

Reference is made particularly to FIGS. 1, 4 and 7 through 9 of the drawings which illustrate a first embodiment of a novel motor safety switch constructed in accordance with the present invention which includes one main component, namely a switch unit 1. The switch unit 1 includes hook-up segments 2, 3 and 4 which are located at the forward or front end of the motor safety switch, as viewed in FIGS. 1 and 4. Identical hook-up segments are provided at the back end of the switch unit 1, as is readily apparent from FIG. 9. The segments 2, 3 and 4 are covered partially or totally by small plates (unnumbered) to prevent physical contact with connection or contact making screws 57 (FIG. 9). However, slits or openings (unnumbered in FIG. 9) allow hook-up conductors 58 to be connected to conventional clamps 68 of the switch unit contact system (unnumbered). The connection or contacting making screws 57, for example, can be operated by a screw driver passing through holes 25 through 28 (FIGS. 1 and 4), a hole 56 (FIG. 9), and another hole adjacent the holes 28, 56 of the cover or cover component 5. The holes 25 through 27 are formed in a front part 23 of the cover 5, whereas the holes 28, 56 and another unillustrated hole are provided in the rear cover part 23.

The switch unit 1 carries a pushbutton mechanism or component 22 which includes two manually actuatable pushbuttons 6 and 7 which project upwardly and outwardly and are the respective on and off switches of the switch unit 1. The cover 5 includes two holes 20 and 21 which receive the pushbuttons 6 and 7 while the cover parts 23 and 24 merge into the downward projections 29 and 30, which will be described more fully hereinafter.

Figure 7:
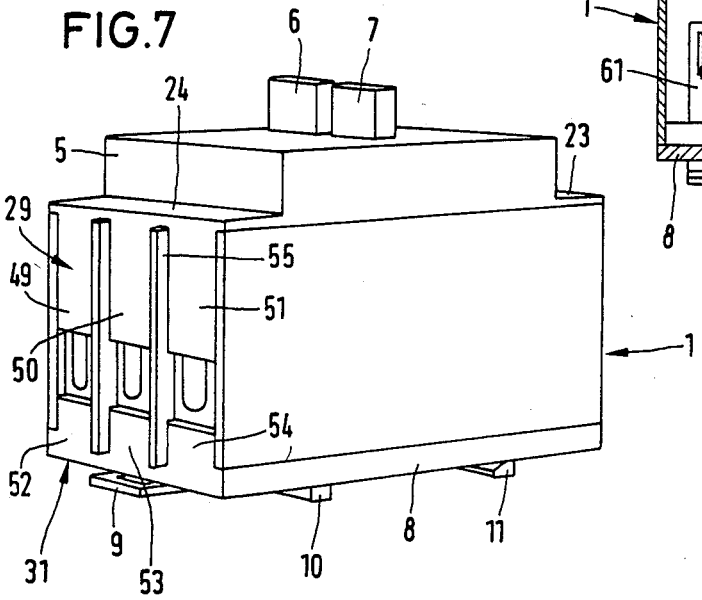
FIG. 7 is another perspective view of the motor safety switch of FIGS. 1 and 4, and illustrates further details thereof including interengaged ribs of the switch unit with outermost walls of the base and cover.

The switch unit 1 of FIGS. 1, 4 and 7 through 9 is also provided with a base plate or base component 8 carrying at its lower side quick coupling means, generally designated by the reference numerals 9, 10 and 11 (FIG. 9) formed as a slider 10 having relatively long handle or arm 9 slidably received in a tube (unnumbered) at the underside of the base 8 and a fixed locking part or tongue 11 opposing the slider 10. A spring (not shown) normally urges the slider 10 to the right, as viewed in FIG. 9, and a hole (not shown) in the handle, arm or frame part 9 receives the blade of a screwdriver for pulling the slider to its fully retracted position (FIG. 9). In this position the slider 10 and the fixed locking part 11 are then placed upon a conventional support rail, the handle 9 is released, and the slider 10 moves toward the fixed part 11 to clamp the conventional support rail therebetween thereby holding the motor safety swich or switch unit 1 in an associated switch cabinet (not shown). The base component or base plate 8 has projections 31 and 32 (FIGS. 4 and 7) which are formed of lamellas or plates covering the segments 2, 3 and 4 which protect individuals against physical contact with electrical components. Hence, as is best illustrated in FIGS. 7 and 9, the projections 29, 30 of the cover 5 and the projections 31, 32 of the base plate 8 have respective integral lamellas, walls or plates 49, 50, 51 and 52, 53 and 54. These lamellae enter spaced (unnumbered) formed by ribs 55 carried by and spaced slightly from the exterior surface (unnumbered) of the housing of the switch unit 1. The projections 29 through 32 can furthermore be provided with ribs parallel to the plane of FIG. 9. In FIG. 9 the longitudinal section passes through two such ribs (unnumbered) of the projections 31 and 32 of the base plate 8.

The switch unit 1 also includes the fixed rail contacts 63, 64 (FIG. 9) which can be opened and closed by a contact strip 62 and are connected to the conductor 58. The latter elements including the fixed contact rails 63, 64 which are part of the overall contact system of the switch unit 1, including both the contacts strip 62 which is spring loaded and a contact strip holder 61, all of a conventional construction.

In addition to the contact system of the switch unit 1, the same also includes a thermal tripper 65 and a magnetic tripper 66. The thermal tripper 65 and the magnetic tripper 66 operate separately through lever means or a lever mechanism 67 shown in relatively simplified form which is operative on the contact-strip holder 61. The contact-strip holder 61 is common to all contact strips of the switch unit 1, though not all are shown. Both the thermal tripper 65 and the magnetic tripper 66 consist of a plurality of single trippers corresponding to the number of phases. In this embodiment there are three phases and, accordingly, only a total of six connections are provided. Advantageously the thermal tripper 65 and the magnetic tripper 66 are in series in the power circuit, that is, in the particular phases, and the thermal tripper 65 is preferably provided at an appropriate location with an adjustment wheel (not shown) for current adjustment purposes.

Reference is made specifically to FIG. 8 in which the pushbuttons 6 and 7 are shown loaded upwardly by springs 60 with each pushbutton 6, 7 carrying a downward projection 59. The projections 59 provide guidance for the pushbutton 6, 7 and act through a suitable mechanism on the contact-strip holder 61 for switching the contact strip 62 between on and off positions. The design is such that upon the actuation of the on pushbutton 6 the circuit is closed and a contact-strip holder 61 is locked in the on position. This locking can be impulsively eliminated by the off pushbutton 7. In the case of overload, the thermostatic tripper 65 and the magnetic tripper 66 act independently from each other on the locking in such a manner that even if only one phase is overloaded, the circuit will nevertheless be turned off.

Figure 10:
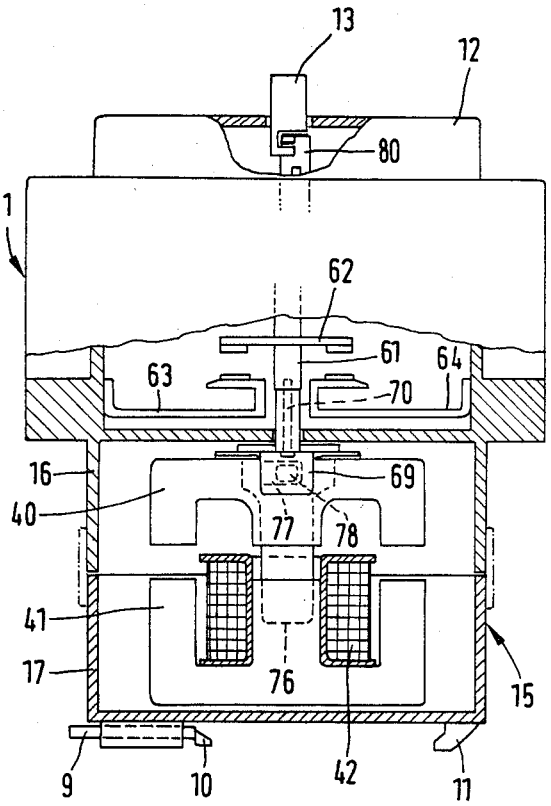
FIG. 10 is a side elevational view partially broken away and shown in longitudinal section of the motor safety switch of FIGS. 2 and 5, and illustrates the details of an armature and its mounting relative to the electromagnetic drive unit.

Reference is now made to FIGS. 2, 5, 10 and 11 of the drawings which illustrate another embodiment of a novel motor safety switch where again the same includes a switch unit 1, heretofore described, as the central component of a plurality of independently assembled components. In the present case the motor safety switch essentially consists of two major components, namely, the switch unit component 1 and an electromagnetic component or drive unit 15. The electromagnetic drive unit 15 is directly joined to the switch unit 1 on the side facing the mounting plane, that is, on the lower side as viewed in FIGS. 10 and 11. An armature 40 is connected by screws 70 (FIGS. 10 and 11) to the contact-strip holder 61 (FIG. 10). The bottom of the electromagnetic drive 15 is provided with quick coupling means 9, 10 and 11, which are not in this case part of the switch unit 1. Moreover, there is no separate base plate associated with the motor safety switch of FIGS. 2, 5, 10 and 11 of the type associated with the switch unit of FIGS. 1 and 4. A cover or cover component 12 (FIGS. 5, 10 and 11) of the switch unit 1 corresponds generally to the cover 5 of FIGS. 1 and 4, except that the same is provided with a single hole 33 (FIG. 5) through which passes a manual on pushbutton 13. The electromagnetic drive unit 15 includes two housing parts 16, 17 (FIGS. 5, 10 and 11) with the housing part 17 which faces the mounting plane (not shown) housing a core 41 and a coil 42 of the electromagnet while the armature 40 thereof is movably held within the housing part 16 of the switch unit 1 through an appropriate mounting, which will be described immediately hereinafter.

Figure 1:
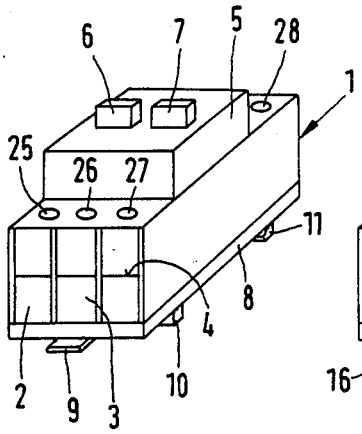
FIG. 1 is a perspective view of a novel motor safety switch of the present invention, and illustrates a single switching unit, a base and an associated cover.
Figure 2:
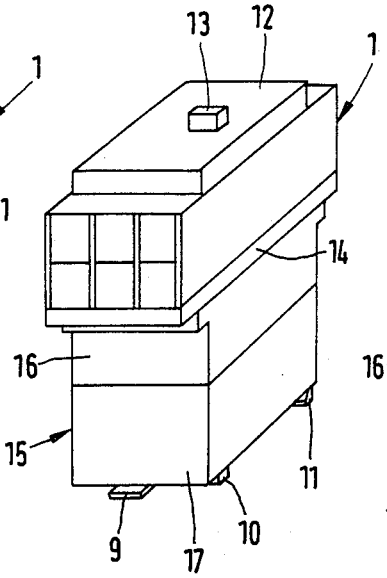
FIG. 2 is a perspective view of another motor safety switch, and illustrates a independent components, namely, a switch unit and an electromagnetic drive unit.
Figure 3:
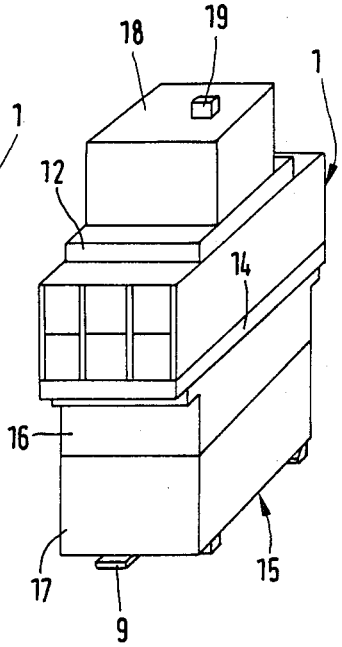
FIG. 3 is a perspective view of another motor safety switch, and illustrates three independent components, namely, a switch unit, an electromagnetic drive unit and a modular contact unit.
Figure 4:
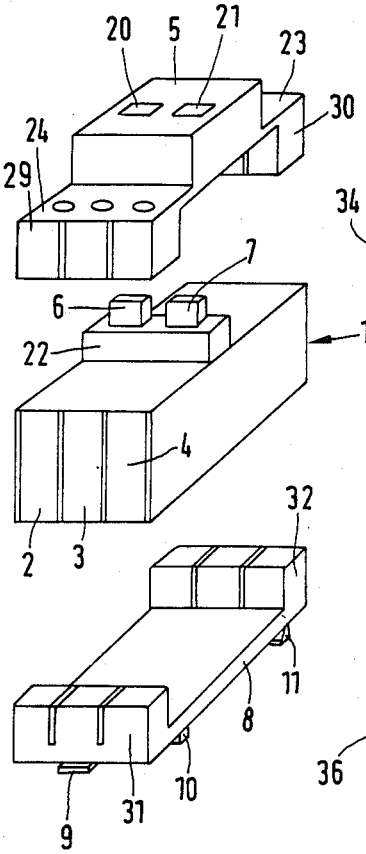
FIG. 4 is an exploded view of the motor safety switch of FIG. 1, and illustrates the manner in which the face, cover and switch unit are constructed and generally aligned before being assembled to the unitized configuration of FIG. 1.
Figure 5:
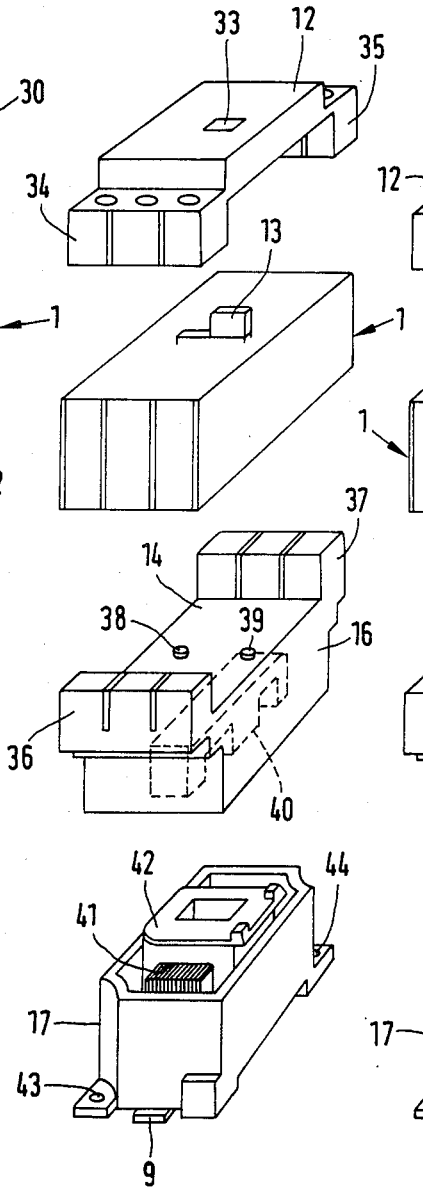
FIG. 5 is an exploded perspective view of the motor safety switch of FIG. 2, and illustrates the components prior to being assembled and unitized to the configuration thereof shown in FIG. 2.
Figure 11:
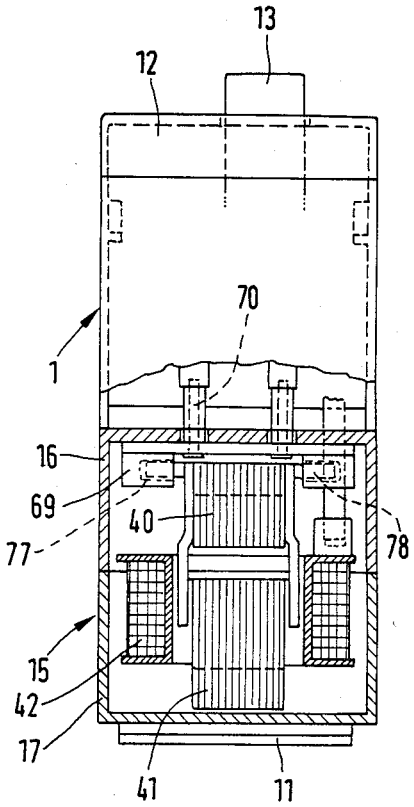
FIG. 11 is an end elevational view of the motor safety switch of FIG. 10 with a portion broken away for clarity, and illustrates the manner in which the armature is connected by pins to blind bores of connecting pieces of the switch unit.
Figure 12:
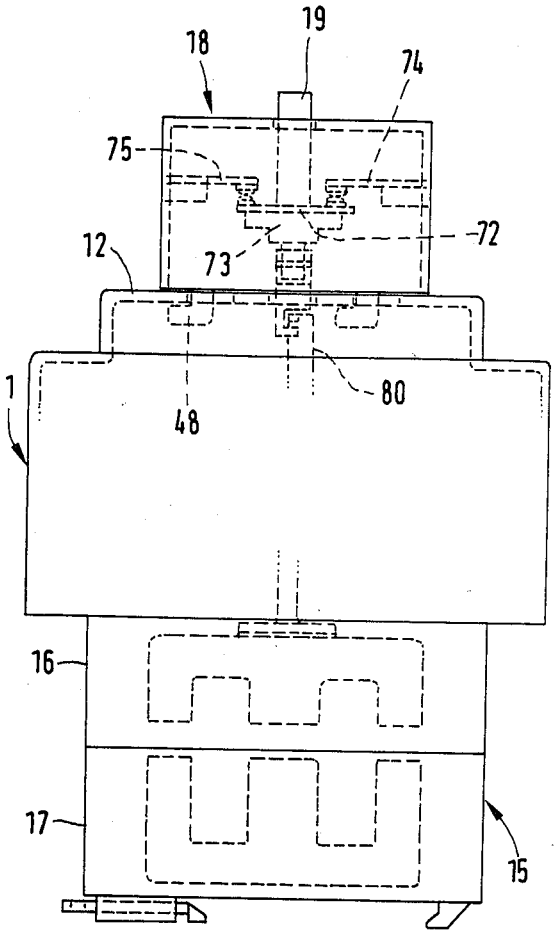
FIG. 12 is a side elevational view of the motor safety switch of FIG. 3, and illustrates the manner in which a push button of the modular contact unit is connected to a push rod of the switch unit.

An optional spacer plate 14 (FIG. 5) can be used as a junction plate between the electromagnetic drive unit 15 and the switch unit 1. The spacer plate 14 can be eliminated if the two components 1 and 15 are joined directly. Advantageously a connecting piece 69 is provided for connecting the armature 40 (FIG. 11) to the switch unit 1 by the screws 70. The connecting piece 69 has a pair of depending connecting pieces 69 each having a blind bore 77 with the blind bore 77 of the connecting pieces 69 being in axial alignment. A generally U-shaped guide member 76 (FIG. 10) is connected to the armature 40 and carries oppositely directed pins 78 which are housed in the blind bores 77. Referring specifically to FIG. 5, the cover 12 may have projections 34, 35 while the housing part 16 includes projections 36, 37. The projections 34, 35 and the projections 36, 37 correspond in structure and function to the respective projections 29, 30 of the cover 5 and the projections 37, 32 of the base 8 of the motor safety switch of FIGS. 1 and 4. An upper end face (unnumbered) of the housing part 16 includes two bore holes 38, 39 (FIG. 5) through which pass guide sleeves or posts (unnumbered) which receive the connection screws 70 (FIGS. 10 and 11). Additionally, the lower housing part 17 (FIG. 5) may be provided with opposite feet 43, 44 and associated bore holes for mounting the motor safety switch in a conventional manner to an associated plate, as opposed to utilizing the quick coupling means 9 through 11.

Figure 6:
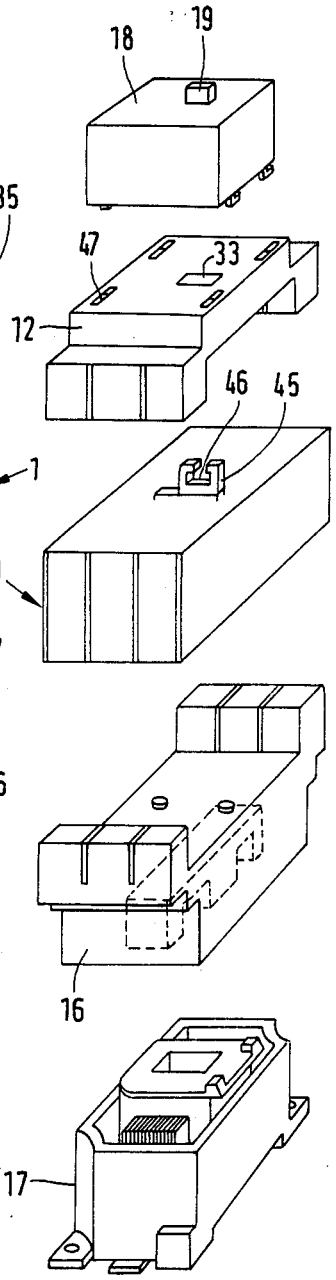
FIG. 6 is an exploded perspective view of the motor safety switch of FIG. 3, and illustrates the individual components prior to being unitized in the configuration thereof shown in FIG. 3.

Another motor safety switch constructed in accordance with this invention and formed of three independent assembled components is shown in FIGS. 3, 6, 12 and 13 of the drawings in which the switch unit 1 and the electromagnetic drive unit 15 are identical to those heretofore described. However, in this case the motor safety switch also includes a further component, namely, a modular contact component or modular contact unit 18. The modular contact unit 18 includes a manual on button 19 projecting through a hole (unnumbered) of the modular contact unit 18. A row of through holes or bore holes (not shown) with appropriate connections screws (also not shown) thereunder are provided in the upper end face of the modular contact unit 18 which is also equipped with an accessory contact system and access openings at two mutually opposite lateral surfaces for the hook-up conductors. Since this structure has been described earlier, the same is not shown or referenced herein by specific reference numerals. In this motor safety switch, the cover 12 of the switch unit 1 is designed somewhat differently from that heretofore previously described relative to FIG. 6 is that it includes four slots 47 (FIG. 6) into which are received hooks 48 for integrating or assembling the cover 12 to the modular contact unit 18. The hooks 48 are simply inserted into the slots 47 and the modular contact unit 18 is slid or displaced to engage these elements while opposite displacement achieves disassembly. A correspondingly simple connection is achieved between the pushbutton 19 and the operative components of the electromagnetic drive unit 15. The latter is achieved through connecting means collectively designated by the reference numerals 45, 71 (FIG. 3) which are basically U-shaped and T-shaped connectors, respectively, which are simply laterally displaced to secure the same to and disassemble the same from each other. The connector 71 is integrated with the undersigned of a contact-strip holder 73 carrying an accessory contact strip 72 at its upper face which in turn cooperates with fixed contact connection rails 74 and 75. The contact strip holder 73 is connected to the pushbutton 19 and depressing the same opens the contacts 72, 74, 75. The same downward movement is transferred through the connecting means 45, 71 to a first switch or push rod 80 of the switch unit 1 corresponding, for example, to the pushbutton 13 of the switch unit 1 of FIG. 5.

Figure 13:
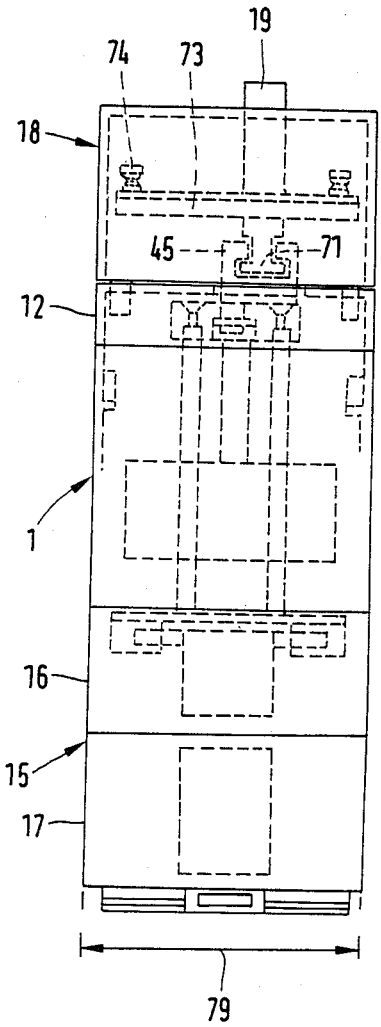
FIG. 13 is a side elevational view of the motor safety switch of FIG. 12, and illustrates a mechanical connector between the push rod and the pushbutton of the switch unit and modular contact unit, respectively.

As is clearly illustrated in FIG. 13, the individual components 1, 15 and 18 all have the same preferably standard width 79, and each is mounted or fastened to each other and to an associated fastening plane which is FIG. 13 is perpendicular to the plane of the Figure or plane normal to the line 79.

What is claimed is:

1. A motor safety switch comprising:

a plurality of assembled independent components;

a first of said components including a switch unit having a contact system, a thermal tripper and magnetic tripper; said contact system including a plurality of contact strips, a contact strip holder common to all of said contact strips, lever means separately operated by said thermal tripper and said magnetic tripper for operating said contact strip holder;

a second of said components being an electromagnetic drive unit;

a third of said components being a modular contact unit; and means for maintaining said components in assembled stacked relationship to each other generally normal to an associated mounting plane with all components in electrical and mechanical operative relationship.

2. The motor safety switch as defined in claim 1 wherein said electromagentic drive unit is assembled directly adjacent said switch unit on the side thereof facing said mounting plane, said electromagnetic drive unit has an armature, a screw connecting said armature to said contact strip holder, said electromagnetic drive unit has a bottom carrying a quick coupling, a cover for said switch unit, and said cover has a hole for a pushbutton of said switch unit.

3. The motor safety switch as defined in claim 2 wherein said screw connects said armature to said contact strip holder through a locking member having a pair of apertures, a U-shaped guide piece carrying said armature, and said guide piece having pins received in said pair of apertures.

4. The motor safety switch as defined in claim 1 wherein said switching unit includes a housing defined by a pair of housing bodies each having a peripheral wall, and a first of said housing bodies having slots slidably receiving the peripheral wall of a second of said housing bodies.

5. The motor safety switch as defined in claim 4 wherein said slots are defined by ribs spaced outwardly from an exterior surface of the first housing body peripheral wall.

6. The motor safety switch as defined in claim 1 wherein said electromagnetic drive unit includes a pair of housing parts, said electromagnetic drive unit further includes a core and a coil housed in a first of said pair of housing parts facing said mounting plane, and said electromagnetic drive unit also includes an armature housed in a second of said pair of housing parts.

7. The motor safety switch as defined in claim 1 wherein said electromagnetic drive unit includes a pair of housing parts, said electromagnetic drive unit further includes a core and a coil housed in a first of said pair of housing parts facing said mounting plane, said electromagnetic drive unit also includes an armature housed in a second of said pair of housing parts, a locking member having a pair of apertures, a U-shaped guide piece carrying said armature, and said guide piece having pins received in said pair of apertures.

8. The motor safety switch as defined in claim 1 wherein said maintaining means includes a plurality of slots of one of said components engaged by respective hooks of another of said components.

9. The motor safety switch as defined in claim 1 wherein said maintaining means includes a plurality of slots of one of said components engaged by respective hooks of another of said components, and means for preventing lateral displacement of said one component and another component.

10. The motor safety switch as defined in claim 1 wherein said switch unit and said modular contact unit are in adjacent relationship, said modular contact unit includes a movable actuator connected to a contact strip holder, said switch unit contact system further includes a push member, and laterally engageable means for connecting said modular contact unit contact strip holder to said push member.

11. The motor safety switch as defined in claim 10 wherein said laterally engageable means includes interengaged generally T-shaped and U-shaped members.

12. The motor safety switch as defined in claim 1 wherein said thermal tripper and said magnetic tripper are connected in series.

13. The motor safety switch as defined in claim 1 wherein said thermal tripper and said magnetic tripper comprise a number of individual trippers corresponding to the number of phases.

14. The motor safety switch as defined in claim 1 wherein said thermal tripper is provided with means for current adjustment.

15. The motor safety switch as defined in claim 1 including a cover for one of said components; said cover having two holes through which each project a manually operable pushbutton for on and off functions of an associated outside power source, and another of said components remote from said cover defining a base having means for quick coupling said base to an associated support.

* * * * *